US006366853B1

(12) United States Patent
Whikehart et al.

(10) Patent No.: US 6,366,853 B1
(45) Date of Patent: Apr. 2, 2002

(54) UTILIZING NAVIGATION DIRECTION DATA IN A MOBILE ANTENNA SIGNAL COMBINER

(75) Inventors: J. William Whikehart; Darby Edward Hadley, both of Novi; John Elliott Whitecar, Plymouth, all of MI (US)

(73) Assignee: Visteon Corporation, Dearborn, MI (US)

( * ) Notice: Subject to any disclaimer, the term of this patent is extended or adjusted under 35 U.S.C. 154(b) by 0 days.

(21) Appl. No.: 09/506,296

(22) Filed: Feb. 17, 2000

(51) Int. Cl.[7] ..... H01Q 3/26

(52) U.S. Cl. ..... 701/213; 701/214; 342/356; 342/357; 342/457; 342/386; 340/995; 340/988

(58) Field of Search ..... 701/213; 343/100 SA, 343/854; 455/276, 137, 273, 136; 342/358, 352, 118, 122, 357; 340/995

(56) References Cited

U.S. PATENT DOCUMENTS 4,217,587 A * 8/1980 Jacomini ..... 343/100 SA
4,850,037 A * 7/1989 Bochmann ..... 455/276
4,939,791 A 7/1990 Bochmann et al.
5,027,126 A * 6/1991 Basehgi et al. ..... 342/372
5,268,968 A 12/1993 Yoshida
5,778,324 A 7/1998 Smith
5,838,742 A * 11/1998 Abu-Dayya ..... 375/347

* cited by examiner

*Primary Examiner*—William A. Cuchlinski, Jr.
*Assistant Examiner*—Tuan C To
(74) *Attorney, Agent, or Firm*—Brinks Hofer Gilson & Lione

(57) ABSTRACT

A method of controlling an antenna signal combiner in a vehicle having multiple antenna elements. The method comprises the steps of receiving broadcast signals from the antenna elements. An antenna beam is steered toward a first steering angle. Navigation data is generated in response to a navigation sensor, the navigation data identifying a relative changes in vehicle direction. The antenna beam is steered toward a second steering angle in response to the relative change in vehicle direction.

10 Claims, 4 Drawing Sheets

| TABLE ADDRESS | COEFFICIENTS | | | | STEER TO (A1) |
|---|---|---|---|---|---|
| 0 | a1,1 p1, 1 | a2, 1 p2, 1 | a3,1 p3, 1 | a4,1 p4, 1 | 0 DEGRESS |
| 1 | a1, 2 p1, 2 | a2, 2 p2, 2 | a3, 2 p3, 2 | a4, 2 p4, 2 | 10 DEGRESS |
| 2 | a1,3 p1, 3 | a2, 3 p2, 3 | a3, 3 p3, 3 | a4, 3 p4, 3 | 20 DEGRESS |
| 3 | a1,4 p1, 4 | a2, 4 p2, 4 | a3, 4 p3, 4 | a4, 4 p4, 4 | 30 DEGRESS |
| 4 | a1,5 p1, 5 | a2, 5 p2, 5 | a3, 5 p3, 5 | a4, 5 p4, 5 | 40 DEGRESS |
| 5 | a1,6 p1, 6 | a2, 6 p2, 6 | a3, 6 p3, 6 | a4, 6 p4, 6 | 50 DEGRESS |
| 6 | a1,7 p1, 7 | a2, 7 p2, 7 | a3, 7 p3, 7 | a4, 7 p4, 7 | 60 DEGRESS |
| 7 | a1,8 p1, 8 | a2, 8 p2, 8 | a3, 8 p3, 8 | a4, 8 p4, 8 | 70 DEGRESS |
| * | * | * | * | * | * |
| * | * | * | * | * | * |
| * | * | * | * | * | * |
| * | * | * | * | * | * |

UTILIZING NAVIGATION DIRECTION DATA IN A MOBILE ANTENNA SIGNAL COMBINER

BACKGROUND OF THE INVENTION

The present invention relates in general to a method and apparatus for controlling an antenna signal combiner in a vehicle.

A primary source of noise and distortion in radio receivers is from multipath interference. This is a localized effect resulting from interaction between separate signals from a transmitter which traverse different paths (e.g., via reflections) to reach a receiving antenna. Because of the superposition of several signals (i.e., echoes and/or direct waves), the signal strength of the received signal changes drastically and may fall below the noise floor. Based upon the differences in path lengths of each received wave, the multipath distortion or fading may include short time delayed multipath interference and/or long-time delayed multipath interference signals. The multipath interference depends upon diverse geographic features and buildings. In an urban area with high buildings along both sides of a street, for example, the broadcast waves propagate along the street and become mixed with many short-time delayed signals. Along a riverside, long-time delayed signals may be mixed with both direct and quasi-direct signals. In a basin, there may be several long-time delayed signals arriving from different directions. This variability has made it difficult to solve the problem of multipath distortion in mobile radio receivers.

A well known means for reducing multipath distortion is through use of space-diversity antennas in a radio receiver system. By switching between antenna signals from spaced apart antennas, specific multipath events can be avoided if the antenna spacing is enough to insure that both antennas will not experience the same multipath event at the same time. However, since space diversity radio receiver systems cannot select only a single wave, they cannot completely avoid multipath distortion. The distortion is especially serious in long-time delay multipath conditions, such as may exist at a riverside or in a basin.

Another technique that has been used to reduce multipath interference is known as antenna beam steering. These systems use an antenna array which is operated in a manner to receive broadcast waves from a single direction only.

Beam steering systems have responded to changes in direction only indirectly by periodically sampling signals from various directions to find a beam steering direction which gives the best reception.

As the vehicle turns, beam steering systems will lose best reception momentarily as the system restores the beam direction to account for the vehicle change in direction. Tracking of the signal can be slow due to the response time of the system thereby causing poor reception.

SUMMARY OF INVENTION

The present invention has the advantage of providing a mobile receiver with greatly reduced multipath distortion while maintaining reasonable gain for the desired signal during reorientation (turning) of the vehicle.

In one aspect of the invention, a method is provided for controlling an antenna signal combiner in a vehicle having multiple antenna elements. The method includes receiving broadcast signals from the antenna elements. An antenna beam is then steered toward a first angle. Navigation data is then generated in response to a navigation sensor wherein the navigation data identifies a relative change in vehicle direction. Next, the antenna beam is steered toward a second angle in response to the relative change in vehicle direction.

Using changes in the heading of the vehicle with respect to antenna beam steering angle will allow better signal tracking, reduce distortion, and maintain a reasonable gain for the desired signal.

DETAILED DESCRIPTION OF PREFERRED EMBODIMENT

Figure 1:
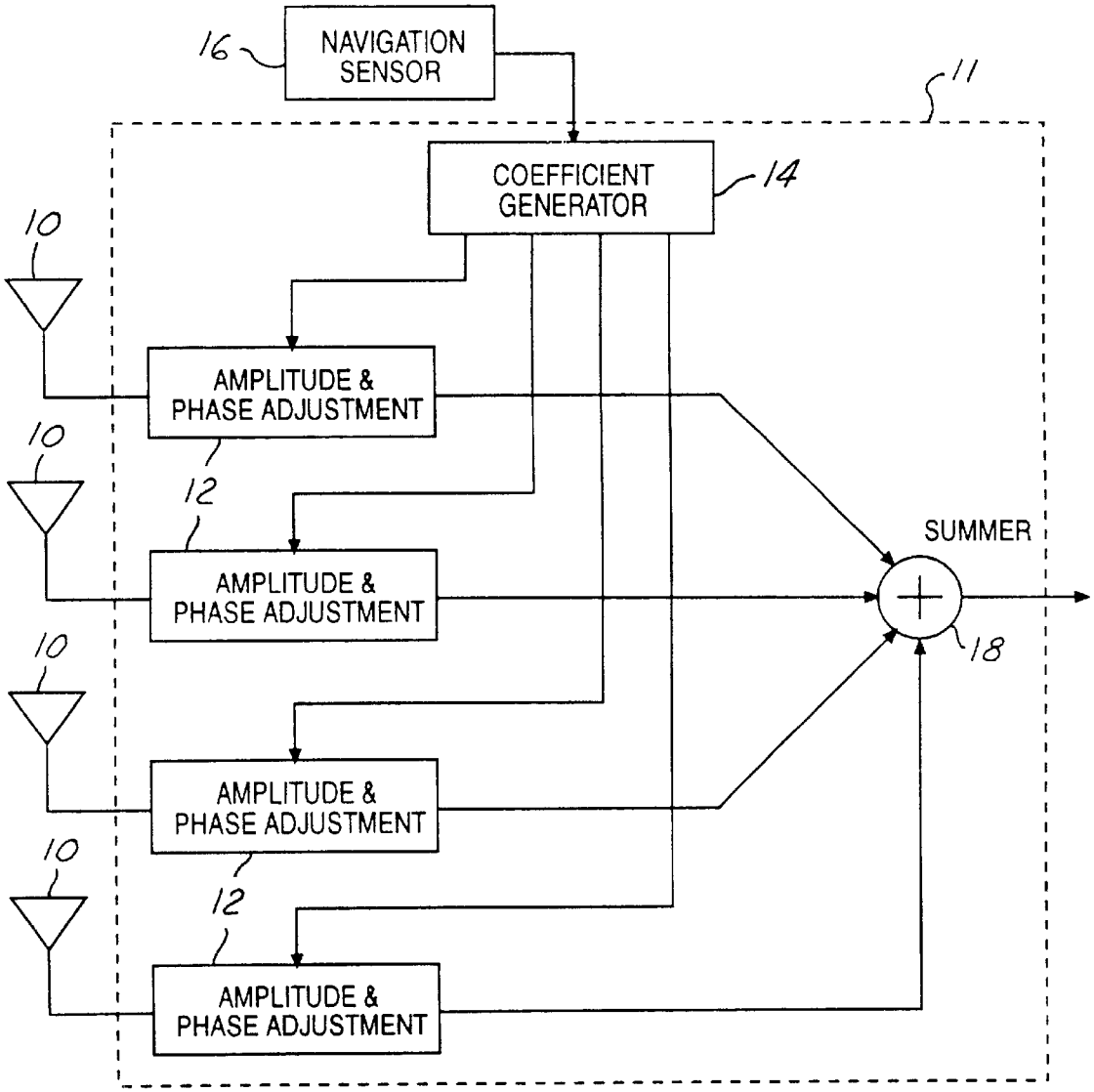
FIG. 1 is a block diagram depicting an antenna combiner which utilizes the present invention.
Figure 2A:
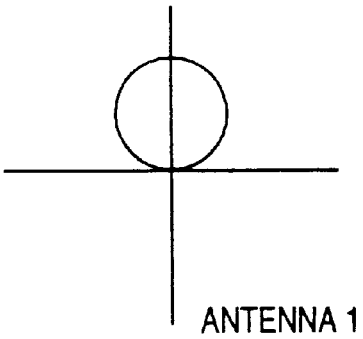
FIG. 2 is a diagram depicting the combination of four antenna patterns from separate antenna elements into a resultant antenna pattern.
Figure 2B:
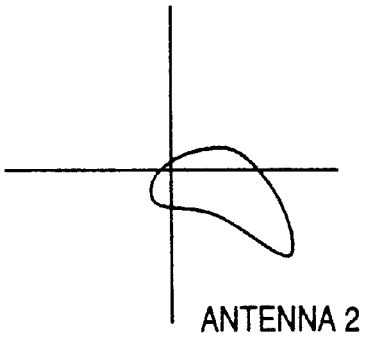
Figure 2C:
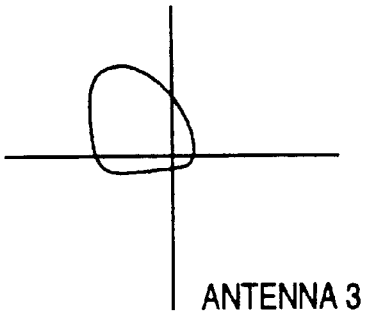
Figure 2D:
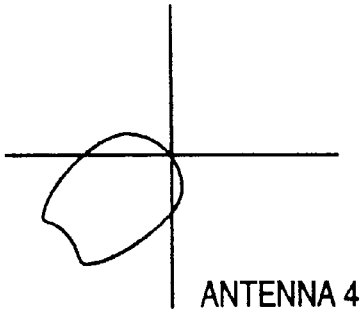
Figure 2E:
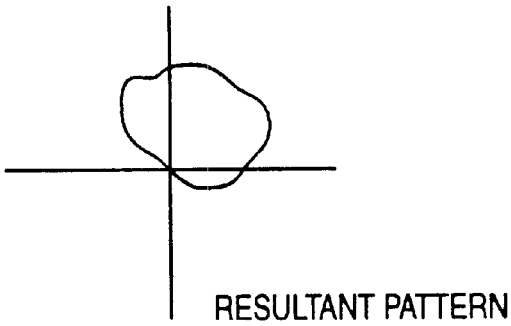

FIG. 1 shows an antenna combiner which utilizes navigational data to greatly improve tracking and response time of antenna beam steering. A plurality of antenna elements 10 and a navigation sensor 16 are coupled to an antenna combiner 11 which combines received broadcast signals into a single antenna signal. The antenna combiner comprises a plurality of amplitude and phase adjuster circuits 12 (each antenna element 10 is coupled to a respective circuit 12), a coefficient generator 14, and a summer 18. Amplitude and phase adjuster circuits 12 and coefficient generator 14 work in concert to reduce multipath distortion while maintaining reasonable gain of a desired signal from a particular direction. Coefficient generator 14 generates beam steering coefficients for each respective beam steering angle to be synthesized by the antenna elements. In a mathematical sense, the beam steering coefficients are a set of complex numbers which multiply the received broadcast signals. Any well known beam steering equation can be used to combine the broadcast signals received.

A navigational sensor 16 is coupled to coefficient generator 14 wherein coefficient generator 14 utilizes navigational sensor 16 to generate appropriate coefficients to take into account changes in the orientation of the vehicle with respect to the incoming broadcast signals.

Summer 18 sums the complex numbers, which represent the broadcast signals, generated by amplitude and phase adjuster circuits 12, into a net strongest single signal. The net result of the summing of the complex numbers is a resultant antenna signal. The resultant antenna signal has a corresponding antenna beam steering angle which is based on the summing of the incoming signals as seen in FIG. 2. This resultant antenna beam/pattern is steered to insure that the resultant signal is the strongest and least distorted signal available. The resultant antenna beam angle is constantly steered towards a direction providing the strongest net signal using a conventional search algorithm.

Navigation data is generated in response to navigation sensor 16 which detects the vehicle's heading. As the vehicle heading changes, a tracking signal containing a new relative heading is sent to the antenna combiner where it is utilized by coefficient generator 14. Navigational sensor 16 can be a GPS receiver or can utilize a tire rotation monitor and/or a vehicle turn indicator to generate a vehicle heading in a conventional manner. The GPS receiver utilizes positions of the vehicle at two different locations which are close in time. The GPS receiver draws a line between the two locations to generate a heading. The tracking signal indicates the magnitude and direction of the angle of a turn the vehicle made.

Summer 18, amplitude and phase adjuster circuits 12, and coefficient generator 14 can be software routines within an embedded controller of a type commonly used in automotive applications.

Figures 3A, 3B:
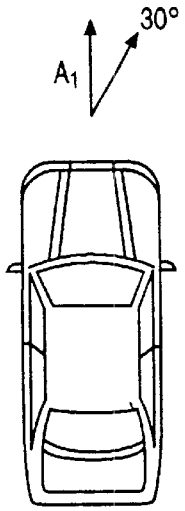
FIG. 3 is a depiction of a table of steering coefficients and a respective angle.
Figure 4:
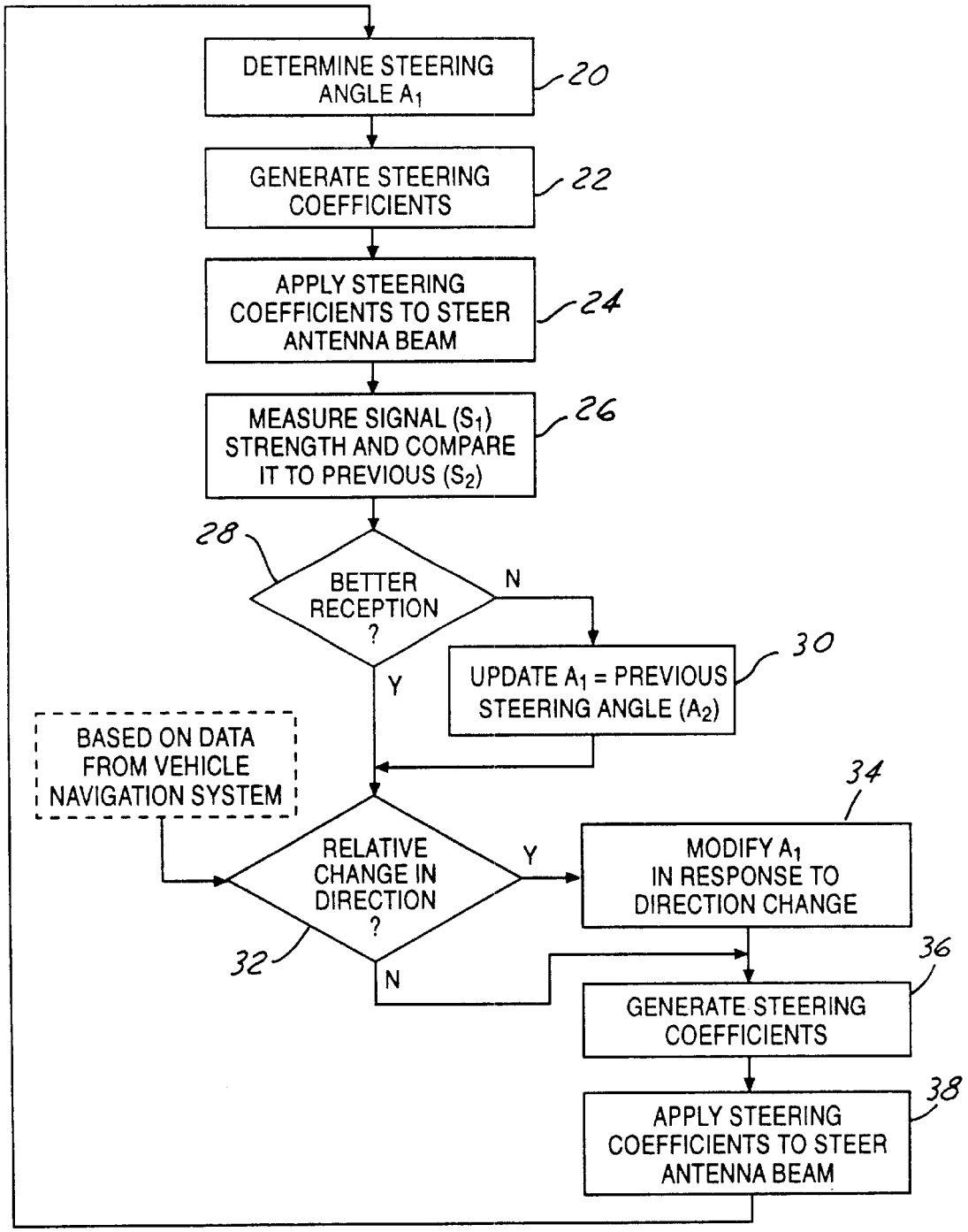
FIG. 4 is a flowchart describing a preferred embodiment of the invention.

A method of controlling an antenna signal combiner in a vehicle having multiple antennas will be described in connection with the flowchart of FIG. 4. When broadcast signals are received, a first steering angle ($A_1$) is determined in step 20 using a steering angle generator. Steering angle ($A_1$) may be offset from the currently best performing direction as part of a search strategy to track the best direction. Steering coefficients are determined by the coefficient generator in response to the first steering angle ($A_1$) in step 22. The steering coefficients are selected from a table shown in FIG. 3 which contains a steering angle with corresponding coefficients. For example, if the steering angle is equal to 20 degrees then a table address pointer will be pointing at a table address of 2. Corresponding coefficients will be chosen accordingly. The coefficients within the table are generated in advance by means well known in the art based on the properties of the antenna elements and the vehicle.

The steering coefficients are then applied to the antenna signals to steer an antenna beam towards the first steering angle ($A_1$) in step 24. In step 26, a measurement of signal strength ($S_1$) is made and compared to a previous measured signal strength ($S_2$) as part of the search for the steering angle that provides the best reception at that moment. If the measured signal strength ($S_1$) is less then the previous measured signal strength ($S_2$) in step 28 then first steering angle ($A_1$) is set equal to a previous steering angle ($A_2$) in step 30. In step 32, the antenna combiner checks the navigation sensor to see if the vehicle has changed its heading. If the vehicle has not changed its heading then steering coefficients are generated in step 36. If the vehicle has changed its heading, the first steering angle ($A_1$) is modified in response to the new heading in step 34. For example, if the vehicle turns 30 degrees, corresponding coefficients which represent a steering angle offset by 30 degrees from the original 20 degree pointer are selected as seen in FIG. 3. If the table address pointer is initially located at table address 2, the 30 degree turn in a first direction will cause the table address pointer to be adjusted to table address 5 and appropriate coefficients will be chosen. Modification of ($A_1$) in response to the direction change can be accomplished in many different ways. Other methods of modifying ($A_1$) include using a weighted average of ($A_1$) and a steering angle equal to the direction change or modifying ($A_1$) by the amount of direction change up to a maximum, such as 30 degrees. Any method which modifies ($A_1$) using the navigation data will suffice.

Steering coefficients are then generated in response to the first steering angle in step 36. The steering coefficients are then applied to steer an antenna beam in step 38 towards the first steering angle ($A_1$).

What is claimed is:

1. A method of controlling an antenna signal combiner in a vehicle having multiple antenna elements, said method comprising the steps of:

receiving broadcast signals from said antenna elements;

steering an antenna beam toward a first steering angle;

generating navigation data in response to a navigation sensor, said navigation data identifying relative changes in vehicle direction; and steering said antenna beam toward a second steering angle in response to said relative change in vehicle direction.

2. The method according to claim 1 wherein said navigational sensor comprises a tire rotation monitor and/or a vehicle turn indicator wherein said tire rotation monitor and/or said vehicle turn indicator generate a vehicle heading.

3. The method according to claim 1 wherein said navigational sensor comprises a GPS receiver.

4. An antenna signal combiner in a vehicle having multiple antenna elements for receiving broadcast signals comprising:

a navigation sensor which indicates relative changes in a vehicle heading; and a summer for generating a net received broadcast signal;

a coefficient generator for generating beam steering coefficients to maximize said net received broadcast signal;

wherein said coefficient generator determines said beam steering coefficients in response to said navigation sensor.

5. The antenna signal combiner of claim 4 wherein said summer and said coefficient are software routines within an embedded controller.

6. The antenna signal combiner of claim 4 wherein said navigation sensor comprises a tire rotation monitor and/or a vehicle turn indicator wherein said tire rotation monitor and/or said vehicle turn indicator generate a vehicle heading.

7. The antenna signal combiner of claim 4 wherein said navigation sensor comprises a GPS receiver.

8. A method of controlling an antenna signal combiner in a vehicle having multiple antenna elements, said method comprising the steps of:

receiving broadcast signals from said antenna elements;

steering an antenna beam toward a first steering angle;

generating navigation data in response to a navigation sensor, said navigation data identifying relative changes in vehicle direction;

generating a second steering angle in response to said navigation data;

generating first steering coefficients and second steering coefficients based on said first steering angle and said second steering;

generating weighted steering coefficients based on said first and second steering coefficients; and steering said antenna beam toward said weighted steering coefficients.

9. The method according to claim 8 wherein said navigational data is provided by a navigation sensor comprising a tire rotation monitor and/or a vehicle turn indicator wherein said tire rotation monitor and/or said vehicle turn indicator generate a vehicle heading.

10. The method according to claim 8 wherein said navigational data is provided by a navigation sensor comprising a GPS receiver.

* * * * *

UNITED STATES PATENT AND TRADEMARK OFFICE

CERTIFICATE OF CORRECTION

PATENT NO. : 6,366,853 B1
APPLICATION NO. : 09/506296
DATED : April 2, 2002
INVENTOR(S) : Whikehart et al.

It is certified that error appears in the above-identified patent and that said Letters Patent is hereby corrected as shown below:

On title page 1, item 73 the Assignee should read --Visteon Global Technologies, Inc.--

Signed and Sealed this

Twenty-ninth Day of May, 2007

JON W. DUDAS
*Director of the United States Patent and Trademark Office*